US006805436B2

(12) United States Patent
Ujita et al.

(10) Patent No.: US 6,805,436 B2
(45) Date of Patent: Oct. 19, 2004

(54) INK STORING DEVICE

(75) Inventors: Toshihiko Ujita, Kanagawa (JP); Junji Shimoda, Kanagawa (JP); Hiroshi Netsu, Kanagawa (JP); Hideaki Okamoto, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 1 day.

(21) Appl. No.: 10/307,991

(22) Filed: Dec. 3, 2002

(65) Prior Publication Data

US 2003/0128260 A1 Jul. 10, 2003

(30) Foreign Application Priority Data

Jan. 4, 2002 (JP) ..... 2002-000169

(51) Int. Cl.[7] ..... B41J 2/175
(52) U.S. Cl. ..... 347/86
(58) Field of Search ..... 347/84, 85, 86, 347/87

(56) References Cited

U.S. PATENT DOCUMENTS

| | | | |
|---|---|---|---|
| 4,671,692 A | 6/1987 | Inaba | 401/199 |
| 5,010,354 A | 4/1991 | Cowger et al. | 346/140 R |
| 5,047,790 A | 9/1991 | Cowger et al. | 346/140 R |
| 5,488,401 A | 1/1996 | Mochizuki et al. | 347/86 |

FOREIGN PATENT DOCUMENTS

| | | | |
|---|---|---|---|
| EP | 0 683 051 | 11/1995 | |
| EP | 0 927 637 | 7/1999 | |
| JP | 3-139562 | 6/1991 | |
| JP | 4-179553 | 6/1992 | |
| JP | 02001001682 A * | 1/2001 | B41J/2/175 |

OTHER PUBLICATIONS

European Search Report, dated Mar. 13, 2003, in EP Application No. 02 02 7080.

* cited by examiner

*Primary Examiner*—Anh T. N. Vo
(74) *Attorney, Agent, or Firm*—Fitzpatrick, Cella, Harper & Scinto

(57) ABSTRACT

The present invention provides a liquid storing device which can be manufactured inexpensively, which allows various liquids such as ink to be used in a chemically stable manner, and which can stably supply a liquid by reducing channel resistance irrespective of changes in position during operation to generate a predetermined negative pressure. To achieve this object, in one preferred mode, a plurality of thin plates are disposed at predetermined intervals to form a storing portion in which predetermined capillary force is generated. Furthermore, a predetermined gap is formed between the storing portion and a liquid outlet to form a guiding portion in which capillary force is generated which is stronger than the capillary force of the storing portion.

10 Claims, 25 Drawing Sheets

| | t [mm] | h [mm] |
|---|---|---|
| 1 | 0.5 | 23 |
| 2 | 0.3 | 38 |
| 3 | 0.2 | 58 |
| 4 | 0.1 | 115 |
| 5 | 0.05 | 230 |

FIG.12

INK STORING DEVICE

This application claims priority from Japanese Patent Application No. 2002-000169 filed Jan. 4, 2002, which is incorporated hereinto by reference.

BACKGROUND OF THE INVENTION

1. Field of the Invention

The present invention relates to a liquid reserving or storing device or reservoir that can reserve or store a liquid.

2. Description of the Related Art

For ink-jet printing apparatuses, a large number of means have been proposed and put to practical use which supply ink to an ink-jet print head from which the ink can be ejected.

The capillary force of nozzles in the ink-jet print head is utilized to supply ink to the ink-jet print head. Accordingly, the external force of pressurizing means, such as a pump, is not required. Thus, except for special cases, it is unnecessary to have a mechanism that delivers ink under pressure from an ink supply tank to the ink-jet print head. On the other hand, to continuously eject ink droplets stably through the nozzles in the ink-jet print head, the ink must be subjected to a very weak negative pressure of 100 to 2,000 Pa. This has been important in designing an ink-jet printing apparatus.

A classical ink supply method is known which is used for, for example, an ink-jet printing apparatus of a serial scan type such as the one shown in FIG. 1.

The printing apparatus in this example sequentially prints an image on a sheet 17 as a printing medium by alternately performing a printing operation of ejecting ink from an ink-jet print head 12 on the basis of image data while moving a carriage 11 with the mounted the ink-jet print head 12 in a main scanning direction shown by arrow A, and a transporting operation of transporting the sheet 17 in a sub-scanning direction shown by arrow B and crossing the main scanning direction. Reference numeral 15 denotes a guide shaft that guides the carriage 11 so as to be movable in the main scanning direction. Reference numeral 16 denotes a platen roller. Reference 18 denotes a cap that can cap a nozzle portion (ink ejection port portion) of the print head 12. The print head 12 can execute a recovery process for allowing ink to be ejected properly, by (preliminarily) ejecting ink that does not contribute to image printing, into the cap 18. Further, a suction recovery process can be executed to allow ink to be ejected properly, by introducing negative pressure into the cap 18 capping the print head 12 to suction ink out from an ink ejection port.

A configuration of the print head 12 can be employed which includes an electrothermal converter used to eject ink droplets through the ink ejection port. That is, the electrothermal converter generates heat to cause film boiling, so that the resulting bubbling energy is utilized to eject ink droplets through the ink ejection port.

A method of supplying ink in such a printing apparatus comprises supplying ink from an ink reserving or storing device 13 such as an ink bag through a tube 14 to the print head 12 mounted on the carriage 11 as shown in FIG. 1. With this method, to exert negative pressure on ink supplied to the print head 12, the ink reserving device 13 is arranged on a surface located several centimeters lower than the gravitational height (also referred to as a "head") of the print head 12. Thus, the method of exerting negative pressure using the head difference can be achieved inexpensively using a very simple structure. However, the installation site of the printing apparatus is limited to a flat place such as a desk, or the printing apparatus must be high in order to ensure the head difference. To solve these problems, many attempts have been made to provide the ink reserving device 13 with negative pressure generating mechanism.

FIGS. 2 and 3 illustrate a different conventional example of a negative pressure generating mechanism provided in the ink reserving device.

The negative pressure generating mechanism in FIG. 2 is provided with a metal spring 22 or the like in a flexible bag 21 in which ink is housed. The spring expands the bag 21 in the vertical directions of FIG. 2, shown by the arrows, to generate negative pressure in the ink 23 in the bag 21. Reference numeral 24 denotes an outlet from which the ink 23 is supplied from the bag 21 to the print head. On the other hand, the negative pressure mechanism in FIG. 3 is provided in a pressure regulating valve 31 in a case 30 that houses the bag 21 to control the air pressure in an outer area 32 around the bag 21. Thus, negative pressure is exerted on the ink 22 in the bag 21. That is, the pressure regulating valve 31 performs opening and closing operations so as to maintain a predetermined negative pressure in the outer area 32. When the pressure regulating valve 31 is opened, external air flows into the case 30.

However, a large number of parts are required by the negative pressure generating mechanisms that generate negative pressure in the flexible bag 21 as shown in FIGS. 2 and 3. This increases costs. Further, it is technically difficult to generate a negative pressure of the order of several hundred Pa. Furthermore, the presence of such a negative pressure generating mechanism may degrade the capability of storing available ink. Moreover, the thin bag 21 does not hinder passing of gas sufficiently, so that the open air may enter the bag 21 to expand it or evaporate the ink. Thus, many problems must be solved before the negative pressure generating mechanism can be added to the ink reserving method that uses the bag, while maintaining its reliability.

FIG. 4 is a sectional view of an ink reserving device that uses a sponge method, a presently popular ink reserving method. A sponge-like porous member (ink absorber) 41 can reserve ink on the basis of its own capillary force and can exert an appropriate negative pressure on ink when having a properly selected density. Reference numerals 40, 42, and 43 denote a case, an air intake port, and an ink outlet, respectively. Such a reserving method involves a very simple structure and allows the ink absorber 41 to be manufactured inexpensively by using a commercially available sponge-like porous member. Further, the size of the ink reserving device can be reduced, and the predetermined negative pressure can be generated regardless of changes in its position during operation.

However, general methods of manufacturing a sponge-like porous member do not provide a sufficiently dense porous member. Accordingly, the porous member must be compressed to some degree before use. This causes ink to be used inefficiently, so that the ink reserving device can generally be filled with ink only up to 70% of the volume of the sponge-like porous member. Further, it is difficult to arrange the sponge-like porous member uniformly in the ink reserving device. The nonuniform arrangement of the porous member may cause the ink to be used inefficiently. Further, a part of the ink-jet printing apparatus which contacts with ink is commonly composed of metal such as stainless steel or resin such as polypropylene, polyethylene, or a fluorine resin. When this metal or resin contacts with the ink, a very small amount of decomposed material or additive may dissolve. Many commercially available porous members are composed of a urethane resin and are thus relatively chemically unstable. In recent years, more chemically stable sponge-like porous members made of polypropylene have been employed. However, the sponge-like porous member contacts with ink over a large area and may thus chemically react to the ink or may be eluted into it. As a result, a large amount of product may affect the nozzles in the print head. On the other hand, various types of ink are used in order to enhance the applicability of the ink-jet printing apparatus. However, since the chemical stability of the sponge-like porous member is critical, it has been unavoidable to take proper measures such as changing the formation of the ink to improve its chemical stability, while sacrificing its physical properties.

FIG. 5 is a sectional view illustrating, as an example of another configuration of an ink reserving device, a configuration having functions equivalent to those of the sponge-like porous member, i.e., a configuration having functions of reserving ink and generating negative pressure. As described in Japanese Patent Application Laid-open Nos. 4-179553 (1992) and 3-139562 (1991), this ink reserving device attempts to reserve ink by stacking thin plates 51 together instead of using the sponge-like porous member. Ink reserving portions 53 are formed in the narrow gaps between the plates 51. Reference numerals 50 and 52 denote a case and an ink outlet, respectively. Reference numeral 54 denotes a buffer used to accommodate variations in pressure. Reference numeral 55 denotes a capillary member through which ink from the ink reserving portions 53 is guided to the ink outlet 52. Capillary force is used to reserve ink in the ink reserving portions 53 and generate negative pressure in them. The capillary force is expressed by the classical equation $h=2T\cdot\cos\theta/(\rho\cdot g\cdot r)$. Where, h denotes a difference in liquid level between the interior and exterior of a tube, T is the surface tension of a liquid, $\theta$ is a contact angle, $\rho$ is the density of the liquid, g is gravitational acceleration, and r is the radius of the tube. The ink reserving method using the thus stacked thin plates 51 involves a relatively simple structure. Consequently, it enables reliable dimension management compared to manufacture management used for the sponge-like porous member.

However, the ink reserving device in FIG. 5 requires the capillary member 55 to reliably obtain ink from the ink reserving portions 53. Desirably, the capillary member 55 must be arranged so as to penetrate the plates 51. The capillary member 55 must have capillary force stronger than that of the ink reserving portions 53 and thus has an excessive ink channel resistance. As a result, with a multi-nozzle ink-jet print head that uses a high drive frequency and thus consumes a large amount of ink, dynamic resistance associated with ink supply is increased to cause the ink to be exhausted prematurely.

All conventional ink reserving devices have problems to be solved, and it is desirable to provide an ink reserving device that can be manufactured inexpensively and still provide excellent functions.

SUMMARY OF THE INVENTION

It is an object of the present invention to provide a liquid reserving device which can be manufactured inexpensively, which allows various liquids such as ink to be used in a chemically stable manner, and which can stably supply a liquid by reducing channel resistance irrespective of changes in position during operation to generate a predetermined negative pressure.

There is provided a liquid reserving device that allows a liquid reserved in a liquid reservation chamber to be guided out from an outlet, wherein a plurality of thin plates are disposed in the liquid reservation chamber at predetermined intervals to form a reserving portion in which predetermined capillary force is generated, and a predetermined gap is formed between the reserving portion and the outlet to form a guiding portion in which capillary force is generated which is stronger than the capillary force of the reserving portion.

According to the present invention, the reserving portions that generate predetermined capillary force are formed of the plurality of thin plates disposed at predetermined intervals. The predetermined gap provided between the reserving portion and the liquid outlet forms the guiding portion that generates capillary force stronger than that of the reserving portions. Thus, the simple configuration can be used to smoothly guide the liquid from the reserving portions through the guiding portion to the outlet. This provides an ink reserving device which allows various liquids such as ink to be used chemically stably and which can stably supply a liquid by reducing channel resistance irrespective of changes in position during operation to generate a predetermined negative pressure.

Further, by housing ink in the reserving portions and supplying it to the printing apparatus, the ink can be supplied stably to allow high-grade images to be printed stably.

The above and other objects, effects, features and advantages of the present invention will become more apparent from the following description of embodiments thereof taken in conjunction with the accompanying drawings.

BRIEF DESCRIPTION OF THE DRAWINGS

FIG. 12 is a view illustrating the relationship between capillary force and the distance between thin plates of the reserving device in FIG. 9;

DETAILED DESCRIPTION OF PREFERRED EMBODIMENTS

Embodiments of the present invention will be described below with reference to the drawings.

First Embodiment

Figure 1:
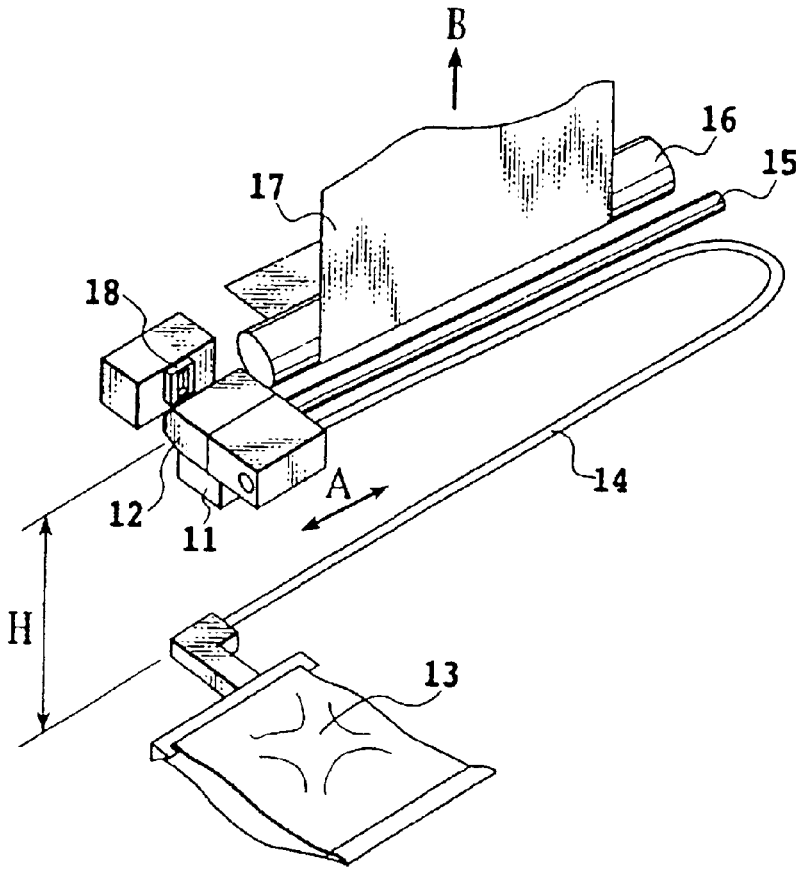
FIG.1 PRIOR ART
FIG. 1 is a perspective view of an essential part of an ink-jet printing apparatus that employs an ink tube supply method.
Figure 2:
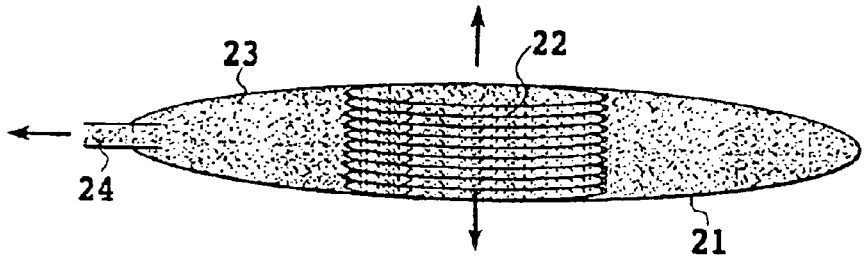
FIG.2 PRIOR ART
FIG. 2 is a sectional view of an essential part of an ink reserving device that uses a spring bag.
Figure 3:
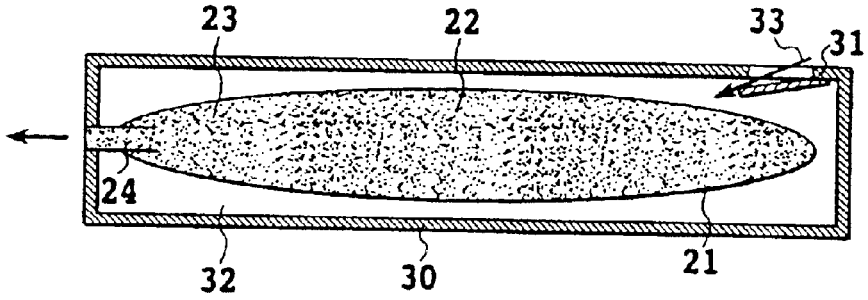
FIG.3 PRIOR ART
FIG. 3 is a sectional view of an essential part of an ink reserving device that uses a bag with a pressure regulating valve.
Figure 4:
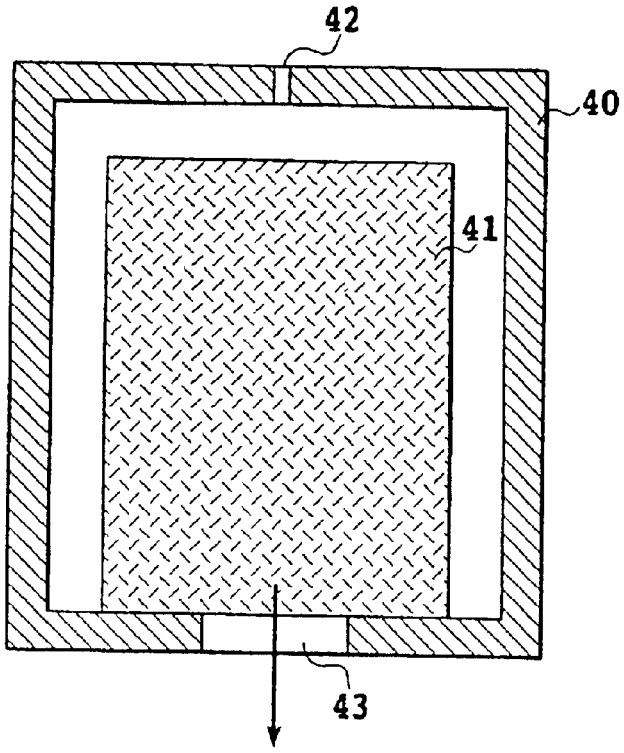
FIG.4 PRIOR ART
FIG. 4 is a sectional view of an essential part of an ink reserving device that uses a sponge.
Figure 5:
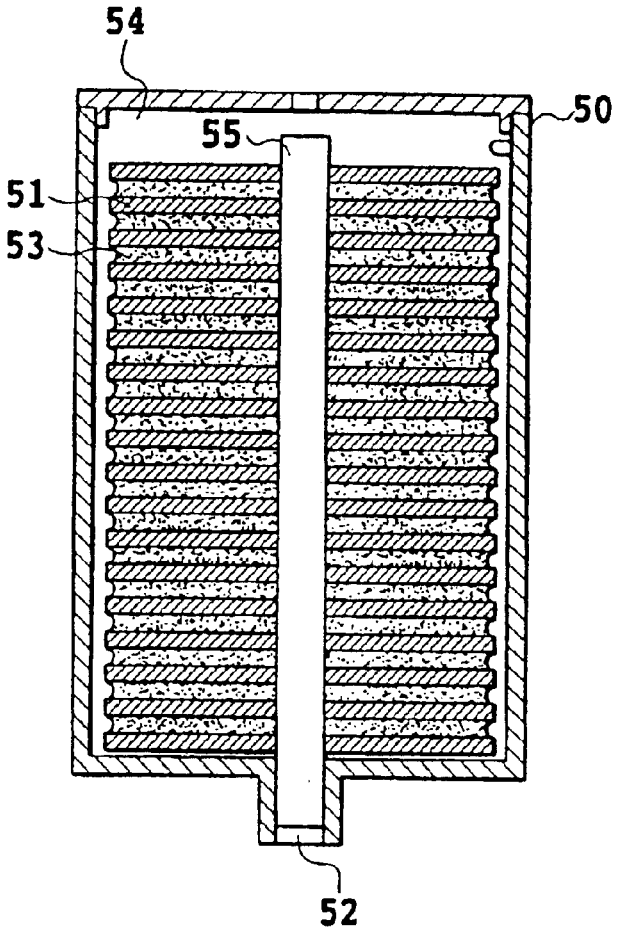
FIG.5 PRIOR ART
FIG. 5 is a sectional view of an essential part of an ink reserving device that uses capillary force.

FIGS. 6 to 12 illustrate a first embodiment of the present invention. In this applied example, a liquid reserving or storing device is provided in an ink-jet printing apparatus such as the one shown in FIG. 1, described previously. Ink reserved or stored in the ink reserving device is supplied to an ink-jet print head 12.

Figure 6:
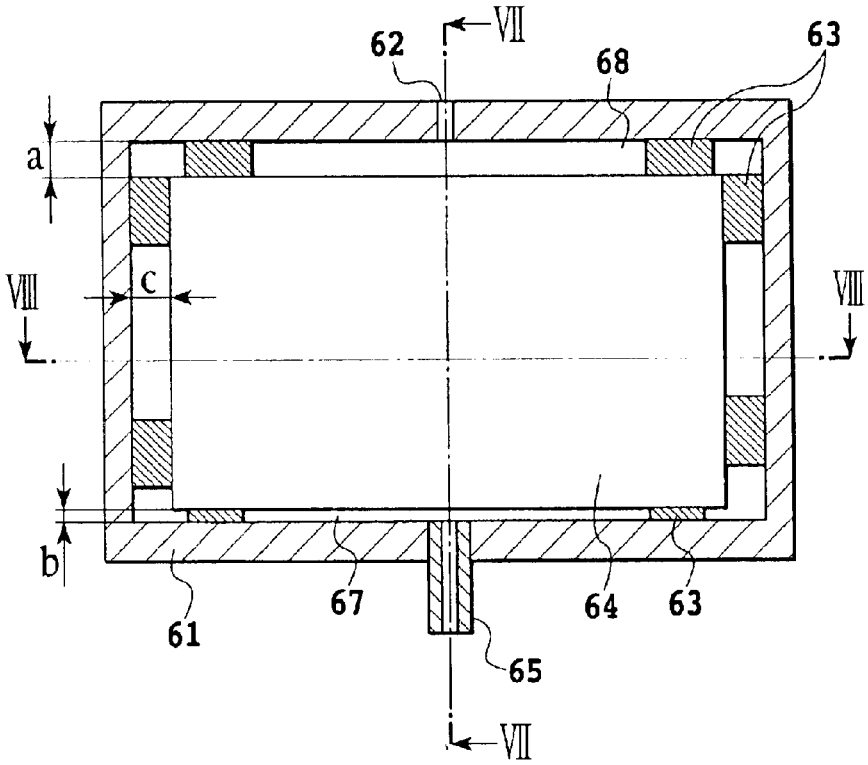
FIG. 6 is a sectional view of an essential part of a reserving device as a first embodiment of the present invention.
Figure 7:
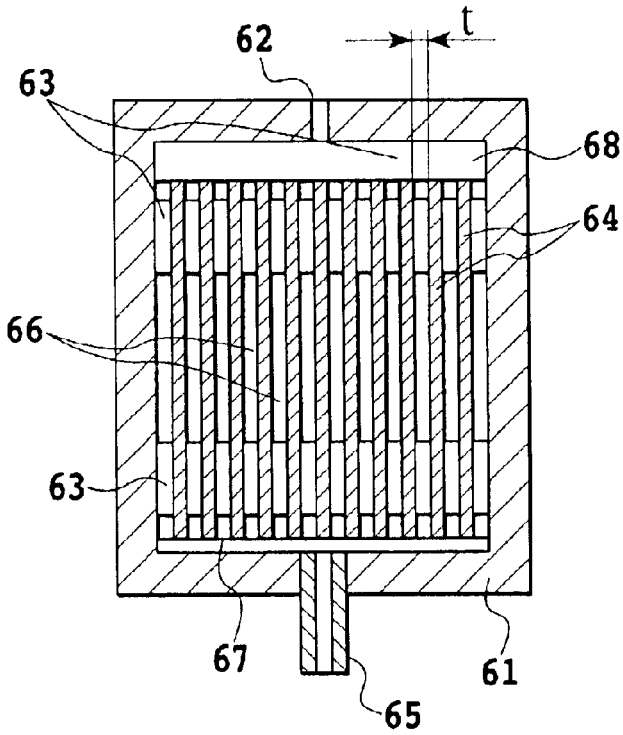
FIG. 7 is a sectional view taken along line VII—VII in FIG. 6.
Figure 8:
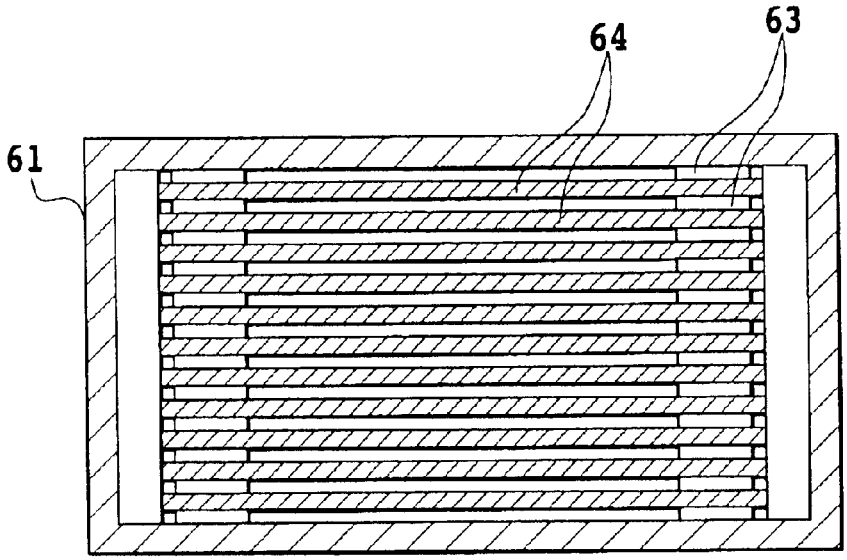
FIG. 8 is a sectional view taken along line VIII—VIII in FIG. 6.

In FIGS. 6 to 8, a case 61 forming an ink reserving or storing chamber is provided with an air intake port 62 and an ink outlet 65. The ink reserving device in this example supplies ink from the ink outlet 65 to an ink-jet print head and takes in external air substituted for supplied ink through the air intake port 62. The case 61 contains a plurality of support members 63 that fix a plurality of thin plates 64. The material of the thin plates 64 is selected or their surfaces are treated so that they are easily wet with ink. The gaps formed between the plurality of thin plates 64 constitute ink reserving or storing portions 66. When the ink reserving portions 66 are filled with ink, capillary force is generated to allow the ink to be held in the ink reserving portions 66.

Capillary force can be expressed by:

$$h=2T\cdot\mathrm{Cos}\ \theta/(\rho\cdot g\cdot r)$$

where h denotes a liquid level (head) [m], T is the surface tension of ink [Nm], θ is the angle at which ink contacts with the thin plates 64, ρ is ink density [Kg/m$^3$], g is gravitational acceleration [m/s$^2$], and r is the radius of the capillary tube [m]. If the distance between the thin plates 64 having a length L is defined as t, the capillary force exerted between these parallel plates can be approximated by:

$$h=4T\cdot\mathrm{Cos}\ \cdot/(\rho\cdot g\cdot t)$$

According to an example of calculation carried out by the inventors, h=115 mm when T=0.03, Cosθ=1, ρ=1063, g=9.8, t=0.0001 m (0.1 mm). Similarly, h has the values shown in FIG. 12 when it is calculated using t as a parameter. In FIG. 12, h is calculated in five cases (cases 1 to 5) in which t is 0.5, 0.3, 0.2, 0.1, or 0.05 mm.

In the ink-jet print head, negative pressure to be exerted on ink normally corresponds to a liquid level (head) of −0 to −200 mm depending on the specification of the print head. The negative pressure of the ink in the print head varies depending on a difference in height between the print head and the ink reserving device. Accordingly, by just the difference in height, the negative pressure of the ink in the ink reserving device must be offset from the desired negative pressure of the ink in the print head. Thus, the desired negative pressure of ink supplied to the print head desirably corresponds to a liquid level (head) of minus several tens of mm to minus 200 mm. In FIG. 12, h meeting this requirement is obtained when the size t of the gap between the ink reserving portions 66 is between about 0.3 and 0.05 mm.

On the other hand, ink filling efficiency I [%] with respect to the occupied volume of n thin plates 64 is expressed by the equation below on the basis of its relationship with the size t of the gap between the ink reserving portions 66. Reference character t denotes the thickness of the thin plate 64.

$$I=(n-1)\cdot t/\{n\cdot d+(n-1)\cdot t\}$$

To increase the ink filling efficiency I, the thickness d of the thin plate 64 may be reduced closer to zero.

The material of the thin plates 64 must be selected so that the thin plates will not be eluted into ink or react to it to generate reaction products or will not be expanded by taking in the ink. Further, the thickness d of the thin plate 64 is desirably minimized in order to improve the ink filling efficiency I. Furthermore, the thin plate 64 is desirably strong in spite of its reduced thickness.

An inexpensive material meeting these requirements for the material of the thin plates 64 can be selected from a group consisting of stainless steel and various plastics, considering the nature of the ink and how easily the thin plates can be assembled together. These plastics may include, for example, olefin-based plastics such as polypropylene, polyethylene, and EVA which allow thin sheets to be obtained easily, Teflon ®-based plastics such as PTEE, or polysulfone-based plastics that can be molded to be thin owing to their fluidity.

An ink guiding portion 67 is formed between the thin plates 64 and the inner wall of the case 61, in which an ink outlet 65 is formed. The capillary force of the ink guiding portion 67 is set to be higher than those of any other sites of the ink reserving device in which capillary force is generated. The support members 63 form buffers 68 of width a or c around the thin plates 64; no capillary force is generated in the buffer 68. If, for example, ink containing a large amount of water is frozen and expanded in a low-temperature environment during distribution, the buffer 68 constitutes a space that absorbs the expansion. In this case, the capillary force of the buffer 68 must be set to be weaker than that of each ink reserving portion 66 so as to return ink from the buffer 68 to the ink reserving portions 66 after the ink has been defrosted.

In view of conditions for the capillary force of the ink guiding portion 67 and buffer 68, if the case 61 and the thin plates 64 have equivalent wettability, the size of the gap t has only to meet the following relationship:

$$b<t<(a \text{ or } c).$$

Figure 9:
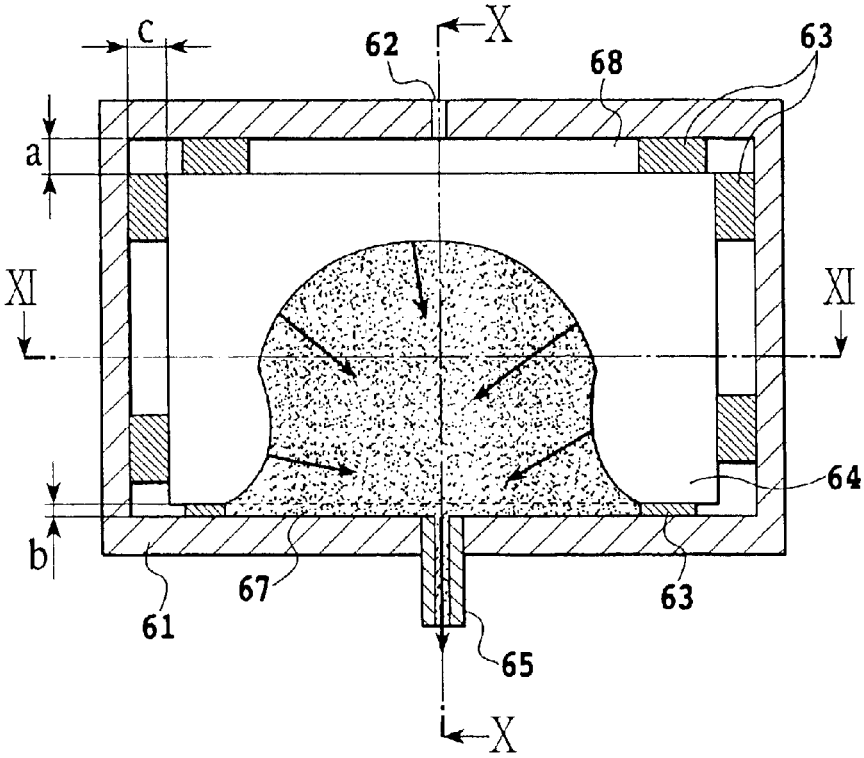
FIG. 9 is a sectional view of an essential part of a reserving device as a second embodiment of the present invention.
Figure 10:
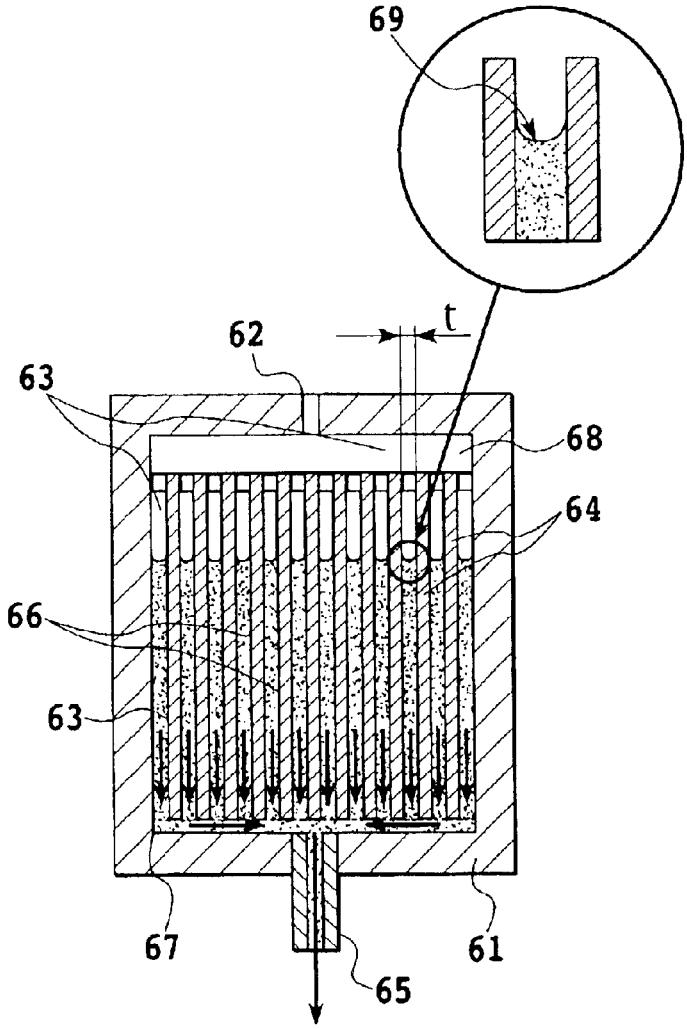
FIG. 10 is a sectional view taken along line X—X in FIG. 9.
Figure 11:
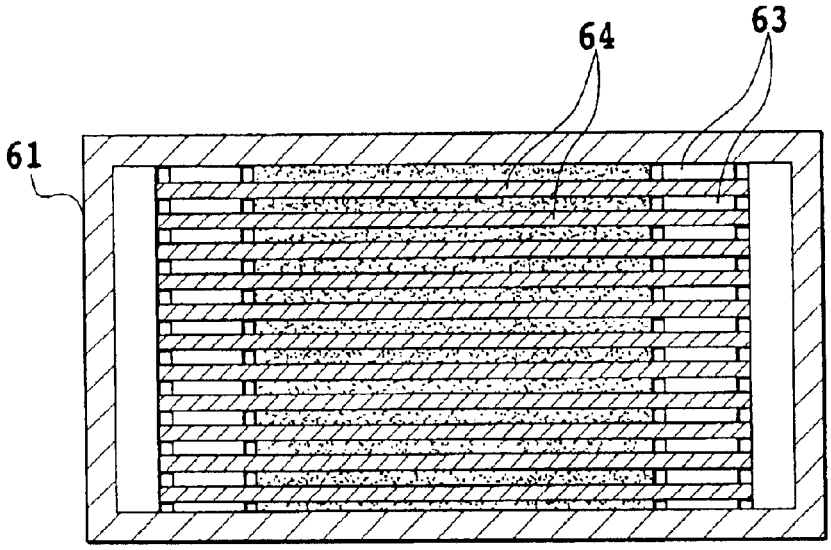
FIG. 11 is a sectional view taken along line XI—XI in FIG. 9.
Figure 13:
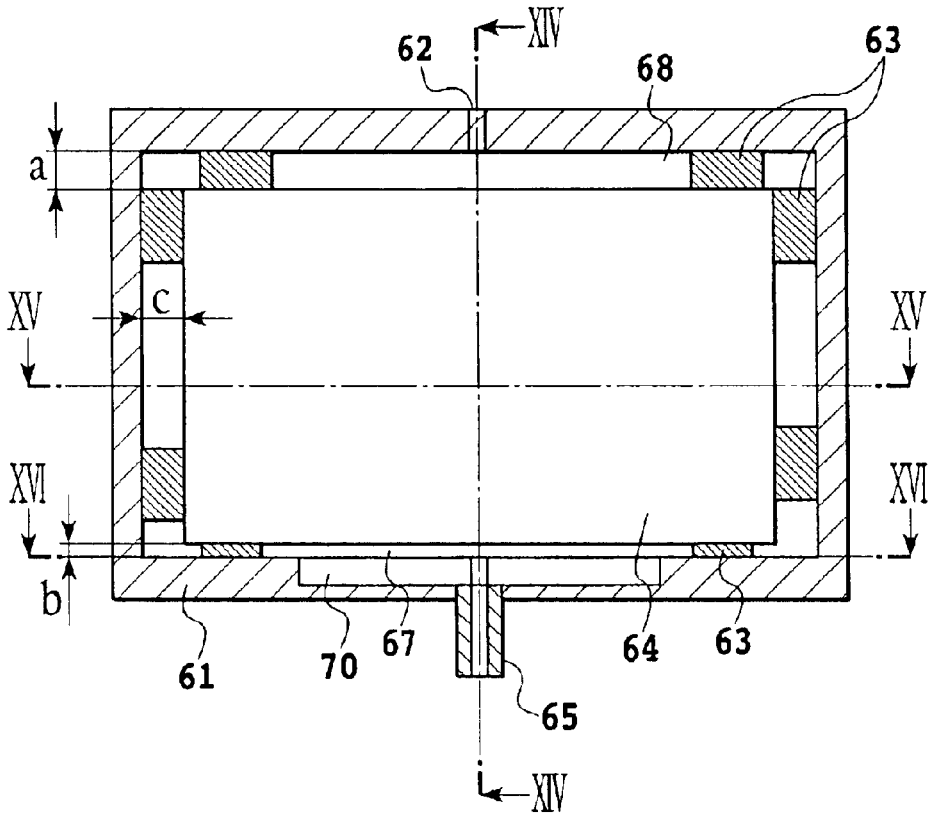
FIG. 13 is a sectional view of an essential part of a reserving device as a third embodiment of the present invention.

FIGS. 9 to 11 illustrate the flow of ink in the ink reserving device in this example.

The ink in the ink reserving portions 66 form meniscus 69 because the thin plates 64 are wet with the ink and because of its surface tension. Accordingly, negative pressure is generated. As the ink in the print head is consumed, the ink in the ink reserving device is supplied to the print head through the ink outlet 65. On the basis of its relationship with the capillary force, the ink in the ink reserving device is sequentially supplied through the gaps between the thin plates 64 as shown by the arrows in FIGS. 9 and 10. Stronger capillary force is generated in the ink guiding portion 67, arranged close to the ink outlet 65, than in the ink reserving portions 66. Accordingly, the ink guiding portion 67 is preferentially filled with ink. Thus, when ink is supplied to the ink-jet printing apparatus, it can be supplied stably without incorporating bubbles.

On the other hand, clearly, resistance to ink flow is composed dominantly of the shearing stress of ink exerted on the thin plates 64. Further, substantially no other resistance components are generated. Thus, the ink reserving device in this example is suitably used particularly for a high-speed ink-jet printing apparatus that consumes a large amount of ink in a short time.

Second Embodiment

FIGS. 13 to 19 illustrate a second embodiment of the present invention. In these figures, those components similar to those of the first embodiment, described previously, are denoted by the same reference numerals. Their description is omitted. In this example, the shapes of the ink reserving portion 66 and ink guiding portion 67 are changed to make the device more reliable.

Figure 14:
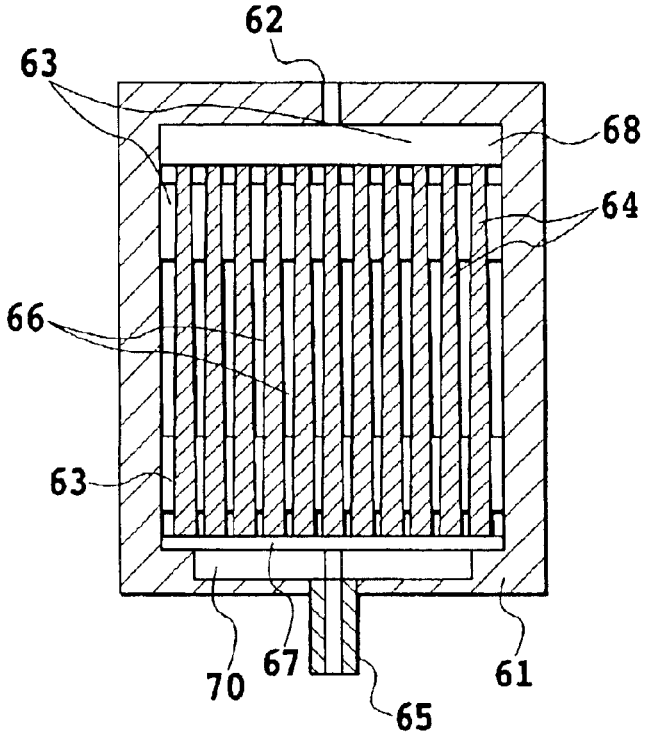
FIG. 14 is a sectional view taken along line XIV—XIV in FIG. 13.
Figure 15:
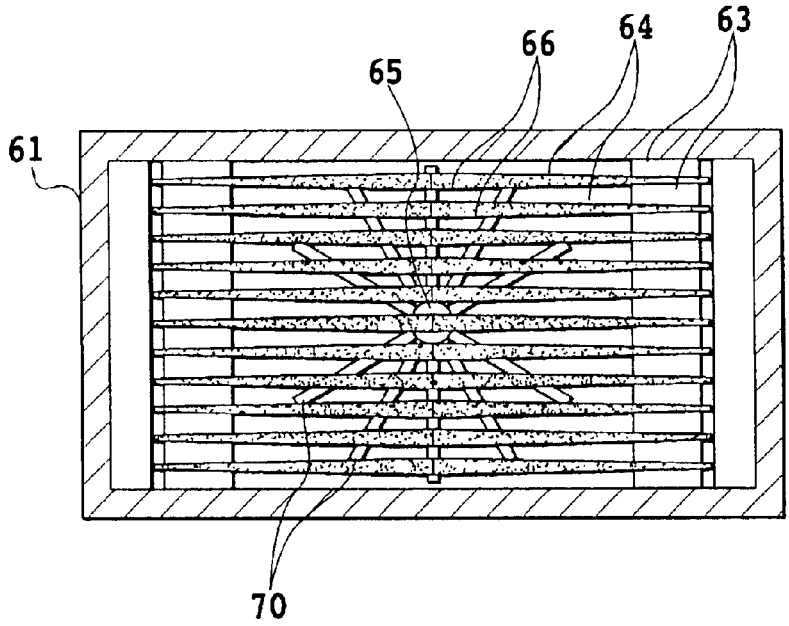
FIG. 15 is a sectional view taken along line XV—XV in FIG. 13.
Figure 16:
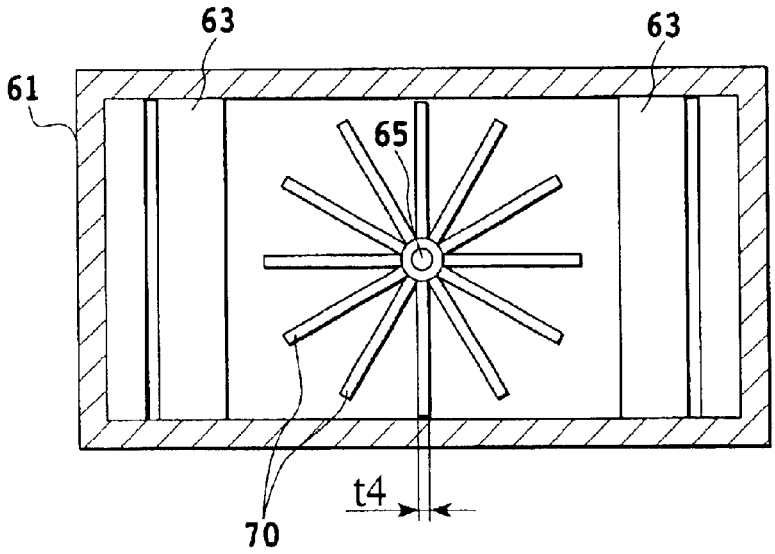
FIG. 16 is a sectional view taken along line XVI—XVI in FIG. 13.
Figure 17:
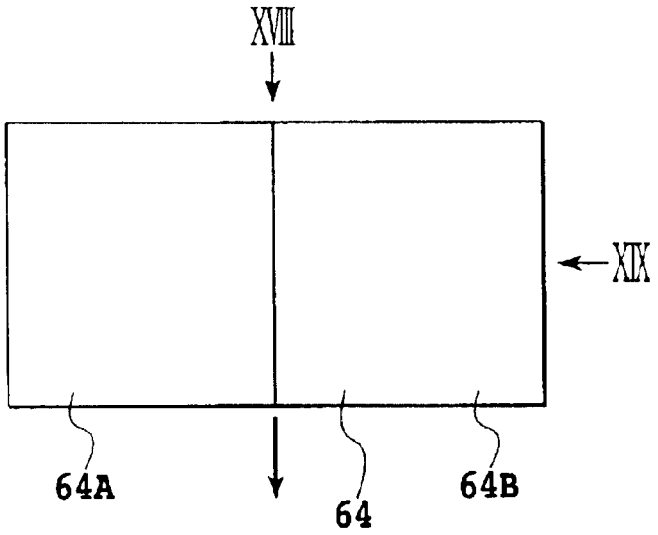
FIG. 17 is a front view of thin plates in FIG. 13.
Figure 18:
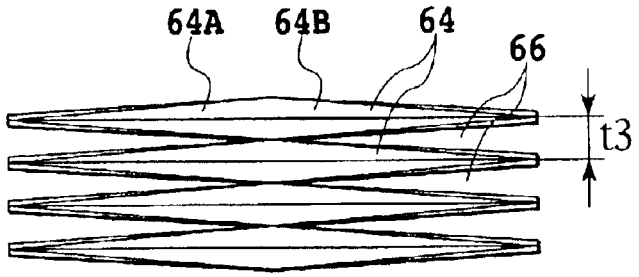
FIG. 18 shows the thin plates as viewed from a direction indicated by arrow XVIII in FIG. 17.
Figure 19:
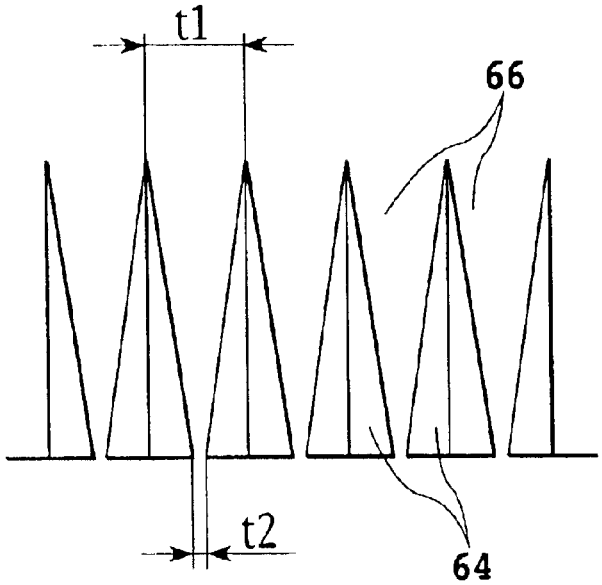
FIG. 19 shows the thin plates as viewed from a direction indicated by arrow XIX in FIG. 17.

First, the ink reserving portions 66 are tapered so as to be gradually narrower toward the ink outlet 65. That is, the thickness of the thin plate 64 gradually decreases toward the top of the device as shown in FIGS. 14 and 19. Thus, when the ink reserving device is shown in a side view such as FIG. 14, the ink reserving portions 66, formed between the thin plates 64, are tapered so as to be gradually narrower toward the bottom of the device, at which the ink outlet 65 is located. FIG. 19 is a conceptual side view of the thin plates 64. In this figure, reference character t1 denotes the width of the ink reserving portion 66 between the tops of the thin plates 64. Reference character t2 denotes the width of the ink reserving portion 66 between the bottoms of the thin plates 64. Furthermore, in FIGS. 15 and 18, the left part of the thin plate 64 is gradually narrower toward the left of the figure, whereas the right part of the thin plate 64 is gradually narrower toward the right of the figure. Thus, when the ink reserving device is shown in a plan view such as FIGS. 15 and 18, the ink reserving portions 66, formed between the thin plates 64, are tapered so as to be gradually narrower toward the ink outlet 65. In FIG. 18, reference character t3 denotes the width of the ink reserving portion 66 between the right or left ends of the thin plates 64.

When the ink reserving portion 66 is thus tapered, the capillary force generated in the ink reserving portion 66 increases with decreasing distance to the ink outlet 65. This allows the ink to be guided more reliably to the ink outlet 65.

Further, a groove 70 is formed in the ink guiding portion 67 so as to extend radially around the ink outlet 65. The capillary force of the groove 70 is equivalent to or stronger than that of the ink guiding portion 67. Accordingly, the ink is guided reliably to the ink outlet 65. The capillary force of the groove 70 is adjusted by the width t4.

In this example, the relationship between the capillary forces of the relevant portions can be maintained properly by establishing the following relationship:

$$t1,\ t3>t2>b>t4$$

Third Embodiment

Figure 20:
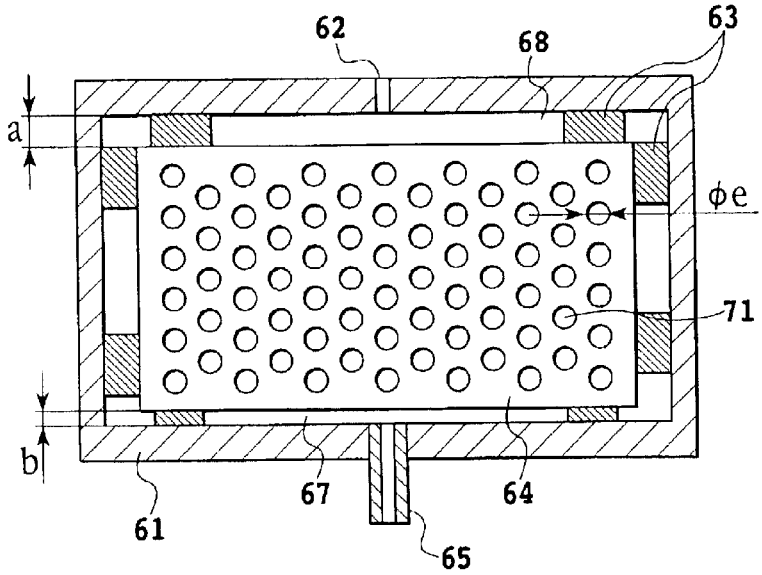
FIG. 20 is a sectional view of an essential part of a reserving device as a fourth embodiment of the present invention.

FIG. 20 illustrates a third embodiment of the present invention. In FIG. 20, those components which are similar to those of the previously described embodiment are denoted by the same reference numerals. Their description is omitted.

In this example, a plurality of holes 71 are formed in the thin plate 64 having a simple smooth surface in the previously described embodiment. The diameter $\phi e$ of each hole 71 must be larger than the width of the ink reserving portion 66, formed between the thin plates 74. If the ink reserving portion 66 is tapered as in the case with the second embodiment, described previously, each hole 71 may have a diameter larger than the width of that part of the ink reserving portion 66 in which it is arranged. Forming such holes 71 enables ink reservation efficiency to increase drastically. The shape of each hole 71 is not limited to a circle as with this example. Any shape may be used as long as the functions of the holes can be provided appropriately.

Fourth Embodiment

Figure 21:
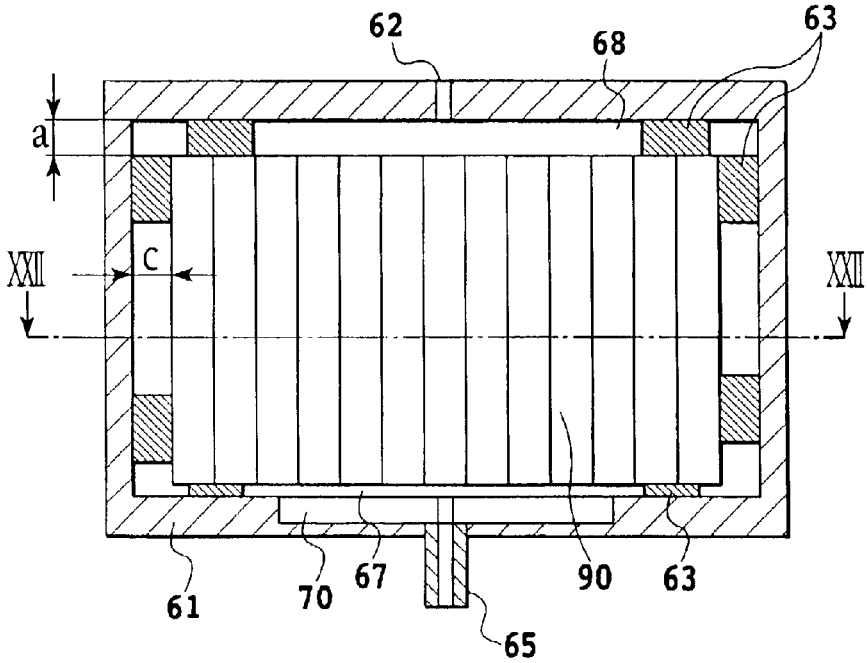
FIG. 21 is a sectional view of an essential part of a reserving device as a fifth embodiment of the present invention.
Figure 22:
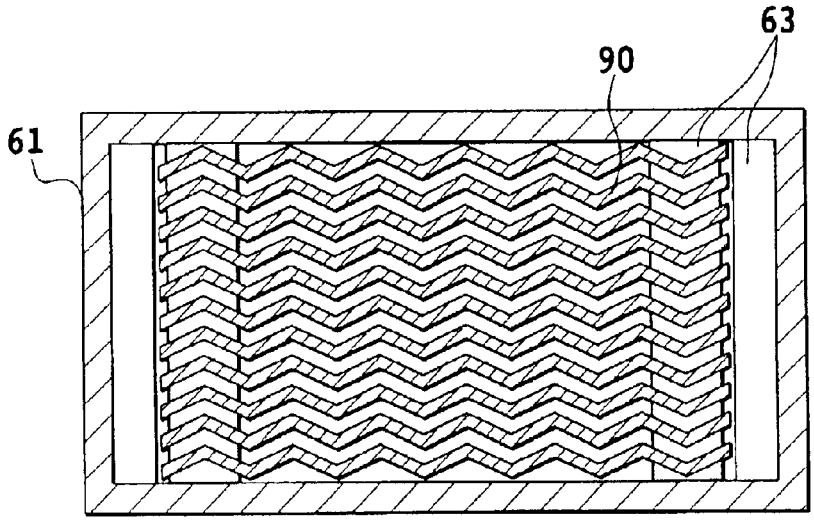
FIG. 22 is a sectional view taken along line XXII—XXII in FIG. 21.
Figure 23:
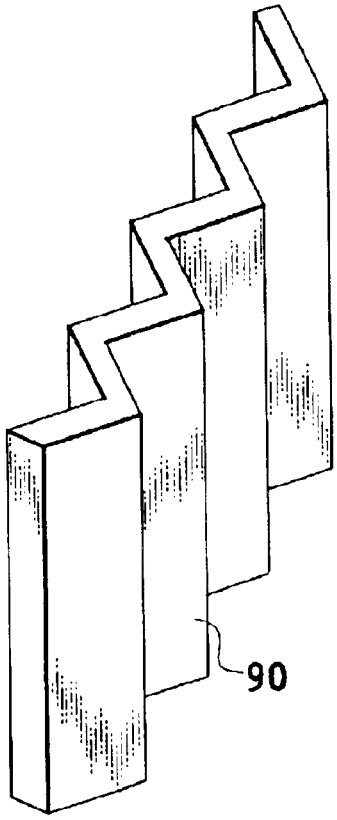
FIG. 23 is a perspective view of thin plates in FIG. 21.

FIGS. 21 to 23 illustrate a fourth embodiment of the present invention. In these figures, those components which are similar to those of the previously described embodiment are denoted by the same reference numerals. Their description is omitted.

This example employs wavy thin plates 90 as the thin plates. The thus shaped thin plates 90 are stronger notably in the vertical direction. Accordingly, this shape can be maintained even if the plates are very thin. This allows ink to be reserved more efficiently.

Fifth Embodiment

Figure 24:
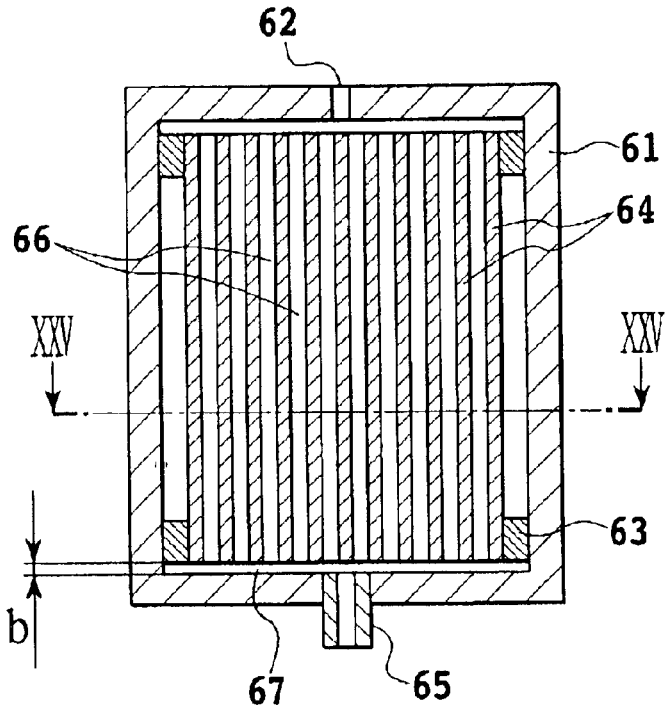
FIG. 24 is a sectional view of an essential part of a reserving device as a sixth embodiment of the present invention.
Figure 25:
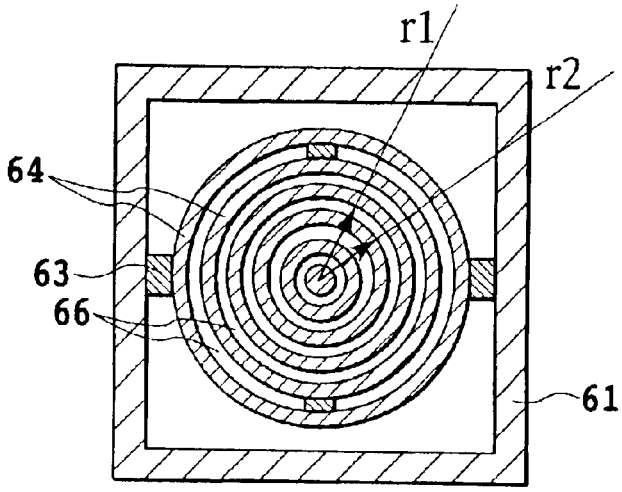
FIG. 25 is a sectional view taken along line XXV—XXV in FIG. 21.

FIGS. 24 and 25 illustrate a fifth embodiment of the present invention. In these figures, those components which are similar to those of the previously described embodiment are denoted by the same reference numerals. Their description is omitted.

In this example, a plurality of cylindrical thin plates 64 are disposed concentrically in the case 61 at equal intervals. The ink reserving portion 66 is formed of the gap t between the adjacent cylindrical thin plates 64. For example, the ink reserving portion 66 is formed by the gap t between a wall surface of a radius r1 and a wall surface of a radius r2. The functions of and the dimensional relationships between the components of the device are similar to those in the first embodiment. When the thin plates 64 are cylindrical as in the case with this example, their strength increases drastically. Accordingly, this shape can be maintained even if the plates 64 are very thin. This allows ink to be reserved more efficiently. Rather than being formed like a cylinder, the thin plate 64 may be formed like a rectangular pipe or to be spiral.

Other Embodiments

The liquid reserving device of the present invention is widely applicable to reserving or storing various liquids other than ink.

Further, the printing apparatus of the present invention can employ various methods other than the serial scan method, described above. For example, the printing apparatus of the present invention can be configured to be of a so-called full line type that uses an elongate print head extending over the length of print area of a printing medium.

The present invention has been described in detail with respect to preferred embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. A liquid storing device that allows a liquid stored in a liquid storage chamber to be guided out from an outlet, comprising:

a plurality of thin plates are disposed in said liquid storage chamber at predetermined intervals to form a storing portion in which predetermined capillary force is generated, a predetermined gap is formed between said storing portion and said outlet to form a guiding portion in which capillary force is generated which is stronger than the capillary force of said storing portion, and said guiding portion is formed of part of said thin plates forming said storing portion and an inner wall of said liquid storage chamber.

2. A liquid storing device according to claim 1, wherein an air intake port is formed so as to introduce external air to inside said liquid storage chamber.

3. A liquid storing device according to claim 1, wherein a groove is formed between said guiding portion and said outlet so that stronger capillary force is generated in said groove than in said guiding portion.

4. A liquid storing device according to claim 3, wherein said groove is formed in the inner wall of said liquid storage chamber.

5. A liquid storing device according to claim 1, wherein the capillary force of said storing portion increases with decreasing distance from said outlet.

6. A liquid storing device according to claim 5, wherein the size of the space between the plurality of thin plates forming said storing portion increases linearly with distance from said outlet.

7. A liquid storing device according to claim 1, wherein the size of the space between the plurality of thin plates forming said storing portion is at least 0.05 mm and at most 0.5 mm.

8. A liquid storing device according to claim 1, wherein the capillary force of said storing portion is at least 50 Pa and at most 2,000 Pa.

9. A liquid storing device according to claim 1, wherein a plurality of holes are formed in each of the plurality of thin plates forming said storing portion.

10. A liquid storing device according to claim 1, wherein said liquid is ink.

* * * * *

UNITED STATES PATENT AND TRADEMARK OFFICE

CERTIFICATE OF CORRECTION

PATENT NO. : 6,805,436 B2
DATED : October 19, 2004
INVENTOR(S) : Ujita et al.

It is certified that error appears in the above-identified patent and that said Letters Patent is hereby corrected as shown below:

Column 1,
Line 34, “the” (second occurrence) should be deleted.

Column 4,
Line 7, “a” should begin a new paragraph.

Column 9,
Line 5, “are” should be deleted.
Line 8, “generated,” should read -- generated, wherein --

Signed and Sealed this

Twenty-fourth Day of May, 2005

JON W. DUDAS
*Director of the United States Patent and Trademark Office*